US005167407A

United States Patent [19]

Namba

[11] Patent Number: 5,167,407

[45] Date of Patent: Dec. 1, 1992

[54] SHEET FEEDING APPARATUS

[75] Inventor: Toyoaki Namba, Nara, Japan

[73] Assignee: Sharp Kabushiki Kaisha, Osaka, Japan

[21] Appl. No.: 696,827

[22] Filed: May 7, 1991

[30] Foreign Application Priority Data

May 9, 1990 [JP] Japan ..... 2-120964

[51] Int. Cl.[5] ..... B65H 3/08

[52] U.S. Cl. ..... 271/98; 271/99; 271/171

[58] Field of Search ..... 271/94, 98, 99, 164, 271/165, 171, 5, 11, 12

[56] References Cited

U.S. PATENT DOCUMENTS

| | | | |
|---|---|---|---|
| 3,198,514 | 8/1965 | Barbera et al. . | |
| 4,219,191 | 8/1980 | Rastorguyeff | 271/94 |
| 4,418,905 | 12/1983 | Garavuso . | |
| 4,469,319 | 9/1984 | Robb et al. | 271/171 |
| 4,627,606 | 12/1986 | Moore | 271/98 |

FOREIGN PATENT DOCUMENTS

| | | | |
|---|---|---|---|
| 55-19859 | 5/1980 | Japan . | |
| 58-78932 | 5/1983 | Japan . | |
| 82537 | 5/1985 | Japan | 271/165 |
| 88734 | 4/1987 | Japan | 271/99 |
| 88735 | 4/1987 | Japan | 271/99 |
| 282029 | 11/1988 | Japan | 271/171 |

*Primary Examiner*—Robert P. Olszewski
*Assistant Examiner*—Steven M. Reiss
*Attorney, Agent, or Firm*—David G. Conlin; Donald R. Castle

[57] ABSTRACT

Air flows from an air flow forming means are jetted to near the downstream end of a plurality of sheets stacked on a laying plate so as to separate either a uppermost sheet or a bottommost sheet from the remaining sheets. The uppermost sheet or the bottommost sheet is vacuum attracted to a vacuum attracting area defined in a feeding belt by a vacuum attracting box. Based on the size of the sheet, the open suction area uncovered by the stacked sheets in the vacuum attracting area is controlled, thereby enabling the feeding belt to control the power of suction thereof to the sheets. Accordingly, a multiple feeding of the sheets can be prevented due to an excessive power of suction.

5 Claims, 12 Drawing Sheets

SHEET FEEDING APPARATUS

BACKGROUND OF THE INVENTION

1. Field of the Invention

The present invention relates to a sheet feeding apparatus for use in, for example, copying machines and printers for feeding sheets including recording paper.

2. Description of the Prior Art

In a copying machine equipped with a recirculating document handler (RDH) for stacking up a plurality of documents of single form thereon, for separating either an uppermost or bottommost document from the remaining stacked documents, feeding the separated document one by one, returning the document to either under the bottommost document or over the uppermost document after reading the image thereof, a sheet feeding apparatus, such as a document feeding apparatus of the above type and a sheet feeding apparatus for separating the prestacked recording paper and feeding the separated recording paper one by one, is used. Also, in various types of printers and photographing devices, a sheet feeding apparatus is used for separating the recording paper to be fed from the remaining stacked paper and feeding the separated paper one by one. In such a sheet feeding apparatus, it is required to separate the sheet to be fed from the remaining stacked sheets one by one. Accordingly, there have been known various sheet separating methods, such as the air flow separating method, separating claw method, and method for separating sheets by the use of a separating roller rotated in a direction opposite the sheet feeding direction.

"Sheet feeding apparatus" disclosed in Japanese Laid-open Patent No. 58-78932 is known as an example of the prior art incorporating the sheet separating method by the use of air flow. U.S. Pat. No. 3,198,514 and Japanese Patent Publication No. 55-19859 disclose respectively similar configurations to the one of the invention. FIG. 1 shows a side elevation of such a configuration. This configuration embodies an intermediate containing device 1 in a copying machine equipped with an RDH. In the case where document images are to be recorded to the both sides of the recording paper, recording paper sheets, to one sides of which have the document images recorded, are temporarily contained in the intermediate containing device 1 with being stacked thereon, and then the stacked sheets are separated one by one to be fed from the intermediate containing device 1 so that the other sides thereof have the images recorded thereto. The intermediate containing device 1 comprises a support tray 3 on which the recording paper sheets 2 are stacked.

At the downstream side of the feeding direction A1 of the recording paper 2 placed on the support tray 3 and in the periphery of the widthwise center of the support tray 3 intersecting with the feeding direction A1 is formed a notch 4. Under the support tray 3 is disposed a feed belt 7 having many penetration holes formed thereon with stretched on a pair of rotating rollers 5, 6 disposed with spaced to each other. The feed belt 7 is exposed at the notch 4. Between the rollers 5, 6 is disposed an air intake duct 8 facing the notch 4 through the feed belt 7. The recording paper 2 on the support tray 3 is vacuum attracted to the feed belt 7 by the air intake duct 8 and fed in the feeding direction A1 by drivingly moving the feed belt 7. On the other hand, there is a possibility that a plurality of the recording papers 2 on the support tray 3 are vacuum attracted to the feed belt 7 at the same time and thereby fed together. In order to obviate such a possibility, above the downstream side of the support tray 3 with respect to the feeding direction A1 are arranged an air injection duct 9 and a plurality of nozzles 10 parallel to the feeding direction A1, the nozzles communicating to each other.

The air injection duct 9 and the support tray 3 of this prior art are arranged as shown in FIG. 1. The nozzles 10 directs the flat air flow of a constant quantity concentratedly to the fixed position in the periphery of the downstream end of the support tray 3 with respect to the feeding direction A1. Thereby, the recording papers 2 stacked on the support tray 3 are effectively separated. Accordingly, assuming a case where relatively large-sized recording papers 2 are used, the constant quantity of the air blown from the nozzles 10 requires to be relatively large. In this case, when the relatively small-sized recording papers 2 are fed, there is a likelihood that such excessive air flow may flap the recording papers 2. On the contrary, assuming a case where relatively small-sized recording paper sheets are used, the constant quantity of the air blown from the nozzles 10 requires to be relatively small. In this case, when the relatively large-sized recording papers 2 are fed, the recording papers 2 cannot be effectively separated, thereby causing troubles such as multiple feeding and poor feeding of the sheets. Similarly, problems as mentioned above occur in the cases where relatively large number of the recording papers 2 or relatively small number of the recording papers 2 are contained in the intermediate containing device 1.

In order to overcome such problems, the quantity of the air flow from the nozzles 10 requires to vary, which feature is incorporated in such prior arts in which the rotating speed of a fan for e.g. separating the air flow is changed. However, such prior arts requires to have a special circuit for changing the rotating speed of the fan and a complicated software for driving such circuit, resulting in a complicated construction.

In the case where the recording paper sheets used therein are limited to the predetermined types or quantities, the prior arts demonstrate the relatively satisfactory capability of separating the sheets. However, in terms of versatility of effectively separating the recording paper sheets in a wide variety of sizes or quantities, the prior arts do not demonstrate sufficient versatility since they are liable to meet a sheet separation failure or feeding failure. Accordingly, a sheet feeding apparatus is desired which has capability of effectively separating the recording paper sheets in a wide range of sizes and quantities.

SUMMARY OF THE INVENTION

The invention has an object of overcoming the aforementioned technical drawbacks and providing an improved sheet feeding apparatus for feeding the sheets of a plurality of sizes, the sheet feeding apparatus having a function of effectively separating the sheets with successfully corresponding to the sizes or quantity of the sheets.

The present invention provides a sheet feeding apparatus comprisies: a laying plate on which a plurality of sheets are stacked; a feeding belt disposed either above or below the sheets for vacuum attracting either the bottommost sheet or the uppermost sheet of the stacked sheets and feeding the vacuum attracted sheet; a vacuum attracting box disposed on the opposite of the sheets through the feeding belt and having an opening along the sheet feeding direction facing the feeding belt for creating a vacuum attracting area in the feeding belt at an area corresponding and opposing to the opening and causing the feeding belt to vacuum attract the sheets; air flow forming means disposed downstream of the laying plate with respect to the feeding direction for jetting a plurality of air flows at the feeding means and near the downstream end portion of the stacked sheets in the widthwise direction of the laying plate; a rear end defining member disposed upstream of the feeding belt with respect to the feeding direction and movable in the feeding direction for aligning the upstream end of the sheets stacked on the laying plate with respect to the feeding direction by being in contact therewith; and driving means for detecting at least one of the quantity or the size of the sheets stacked on the laying plate and, in accordance with the detected quantity or the size, drivingly moving the rear end defining member so as to make an open suction area, which is an uncovered vacuum attracting area by the sheets stacked thereon, larger as the detected quantity or the detected size becomes smaller.

According to the invention, either the bottommost or the uppermost sheet of the sheets stacked on the laying plate is fed with being vacuum attracted to the feeding belt by the vacuum attracting box. At this time, in order to prevent a plurality of sheets from being fed at the same time, the stacked sheets are separated up and down by the air flow jetted from the air flow forming means. The air flow forming means is disposed downstream of the laying plate with respect to the feeding direction. In other words, the air flow forming means is disposed forwardly of the laying plate. A plurality of air flows are formed in the widthwise direction of the laying plate. At this time, the driving means detects at least one of the quantity or the size of the sheets stacked on the laying plate and, in accordance with the detected quantity or the size of the sheets, drivingly moves the rear end defining member so as to make the open suction area uncovered by the stacked sheets in the vacuum attracting area larger as the detected quantity or size of the sheets becomes smaller.

The rear end defining member is disposed upstream of the feeding belt with respect to the feeding direction and the upstream ends of the sheets stacked on the laying plate are aligned by being in contact with the rear end defining member. Accordingly, as the area of the open suction area varies, the ratio of the air flow from the air flow forming means substantially contributing to separation of the sheets varies. Thereby, the drawbacks described with reference to the prior arts caused by the fact that the sheets to be stacked are available in the wide range of sizes or quantities can be overcome and therefore an improved sheet feeding apparatus can be obtained which has a function of effectively separating the sheets in a wide variety of sizes and quantities with successfully corresponding to the size or quantity of the sheets.

As described above, according to the invention, the rear end defining member is disposed upstream of the feeding belt with respect to the feeding direction and the upstream ends of the sheets stacked on the laying plate are aligned by being in contact with the rear end defining member. Accordingly, as the area of the open suction area subject to vacuum attraction by the vacuum attracting box through the opening of the vacuum attracting box varies, the ratio of the air flow jetted from the air flow forming means substantially contributing to separation of the sheets varies. Thereby, the drawbacks described with reference to the prior arts caused by the fact that the sheets to be stacked are available in the wide range of sizes or quantities can be overcome and therefore an improved sheet feeding apparatus can be obtained which has a function of effectively separating the sheets in a wide variety of sizes and quantities with successfully corresponding to the size or quantity of the sheets.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Hereinafter, preferred embodiments of the invention are described with reference to the drawings.

Figure 1:
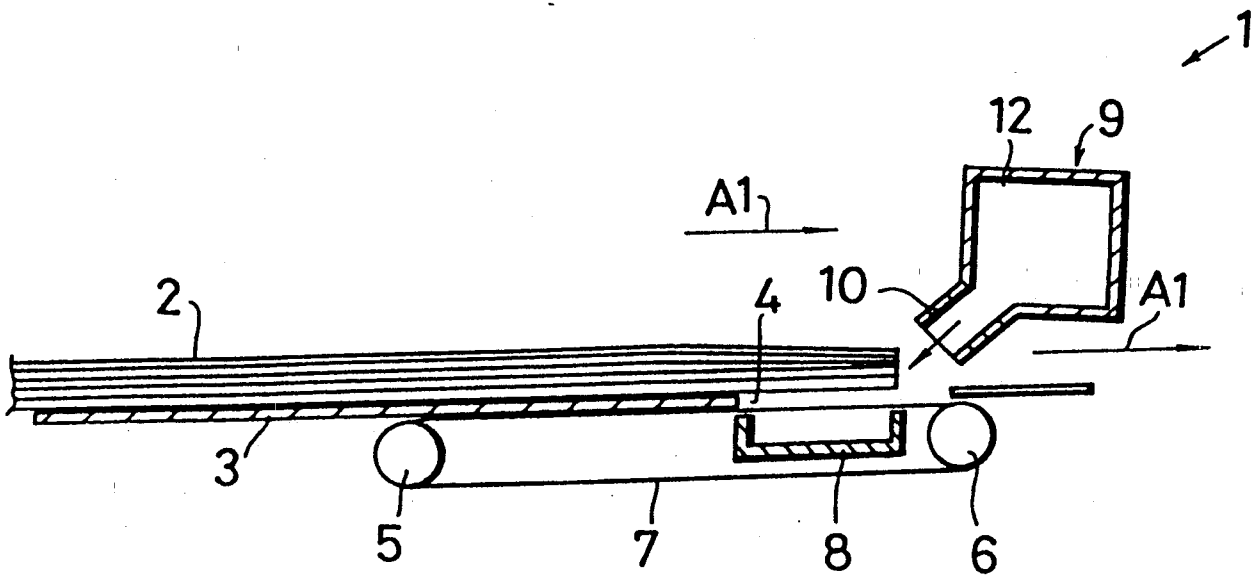
FIG. 1 is a cross sectional view showing a prior art of the invention.
Figure 2:
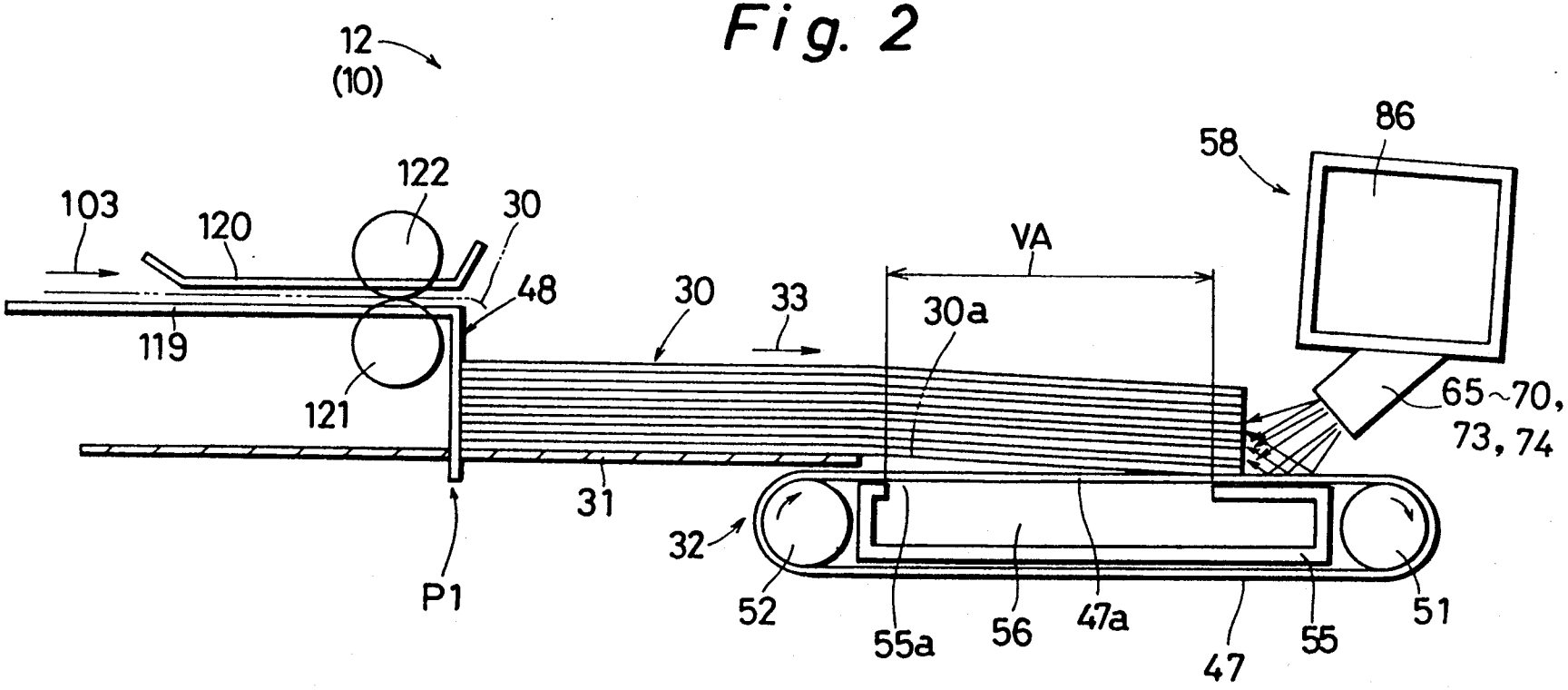
FIG. 2 is a cross sectional view showing an embodiment of the invention.
Figure 3:
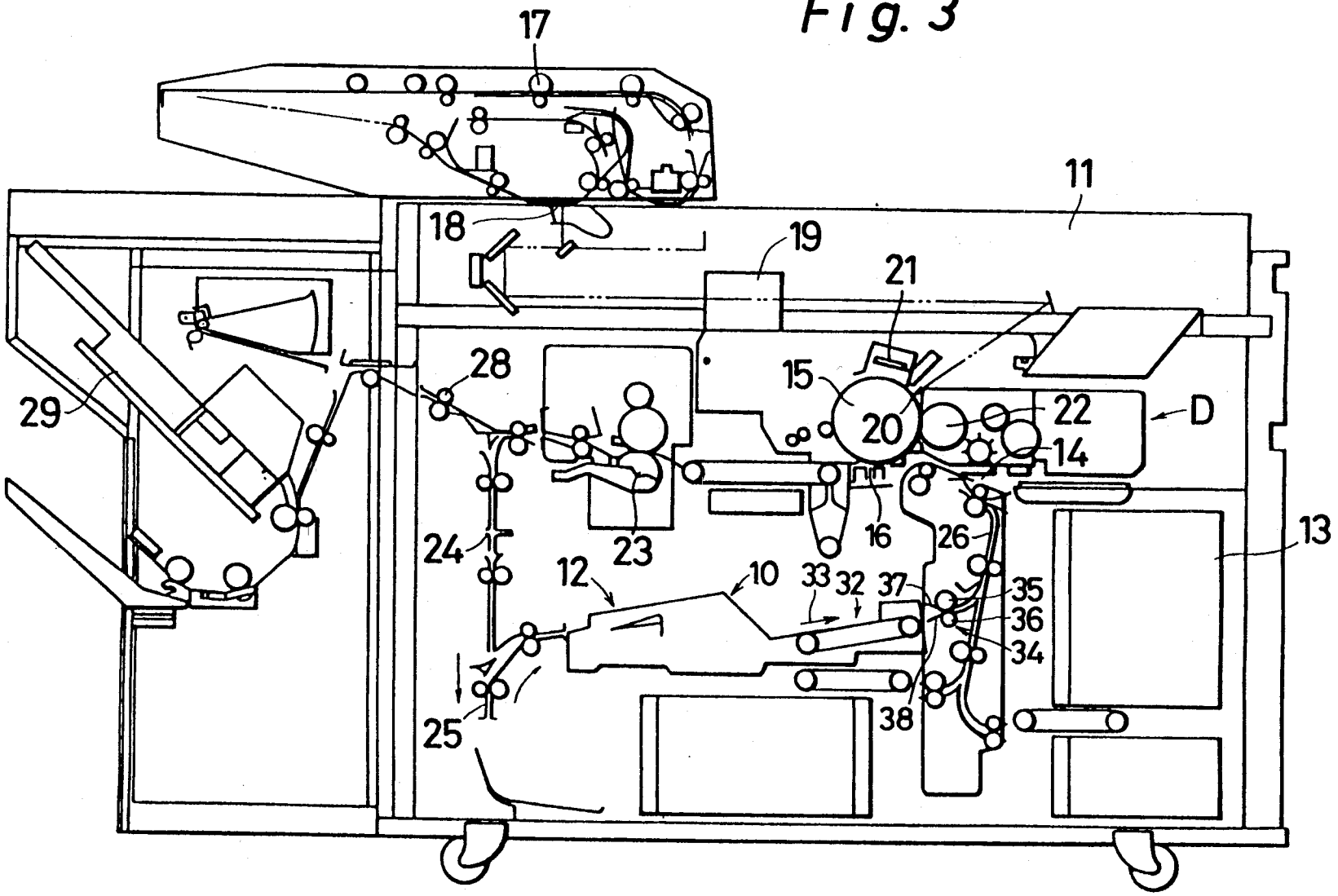
FIG. 3 is a schematic cross sectional view showing a copying machine 11 provided with an intermediate tray 12 shown in FIG. 2.

FIG. 2 is a cross sectional view showing an embodiment of the invention and FIG. 3 is a schematic cross sectional view showing a copying machine 11 provided with a sheet feeding apparatus 10 of the invention. The sheet feeding apparatus 10 having a function of preventing the multiple feeding of the sheets is used as so-called an intermediate tray 12 of the copying machine shown in FIG. 3. The recording paper sheets onto which images are to be copied are fed from a recording paper dispensing unit 13 one by one and introduced through a transporting path 14 to a transfer region 16 of a photoreceptor 15 in the form of a right cylinder. A recirculating document handler (RDH) 17 sends a document to a reading region 18, where the document image of the document is read to be formed onto an exposure region 20 of the photoreceptor 15 by an optical unit 19. Thereby, an electrostatic latent image is formed in the region of the photoreceptor 15 charged by the main corona discharger 21. Thus formed latent image is developed into a toner image by a developing unit D, transferred onto one side of the recording paper passing the transfer region 16, and thereafter fixed onto the recording paper by a fixing unit 23. The recording paper to one side of which the document image is copied, in order to have the other side thereof copied, passes through the transporting path 24, and further inverting path 25 to the sheet feeding apparatus 12 according to the invention serving as an intermediate tray, where the recording papers are temporarily stacked up. The recording paper fed from the sheet feeding apparatus 12 is introduced through transporting paths 26 and 14 again to the transfer region 16 where the recording paper has other side thereof copied with another document image. The recording paper, thus having both sides thereof copied, is fixed by the fixing unit 23 and discharged from a pair of discharge rollers 28 to a discharge tray 29 and consequently received thereon.

Figure 4:
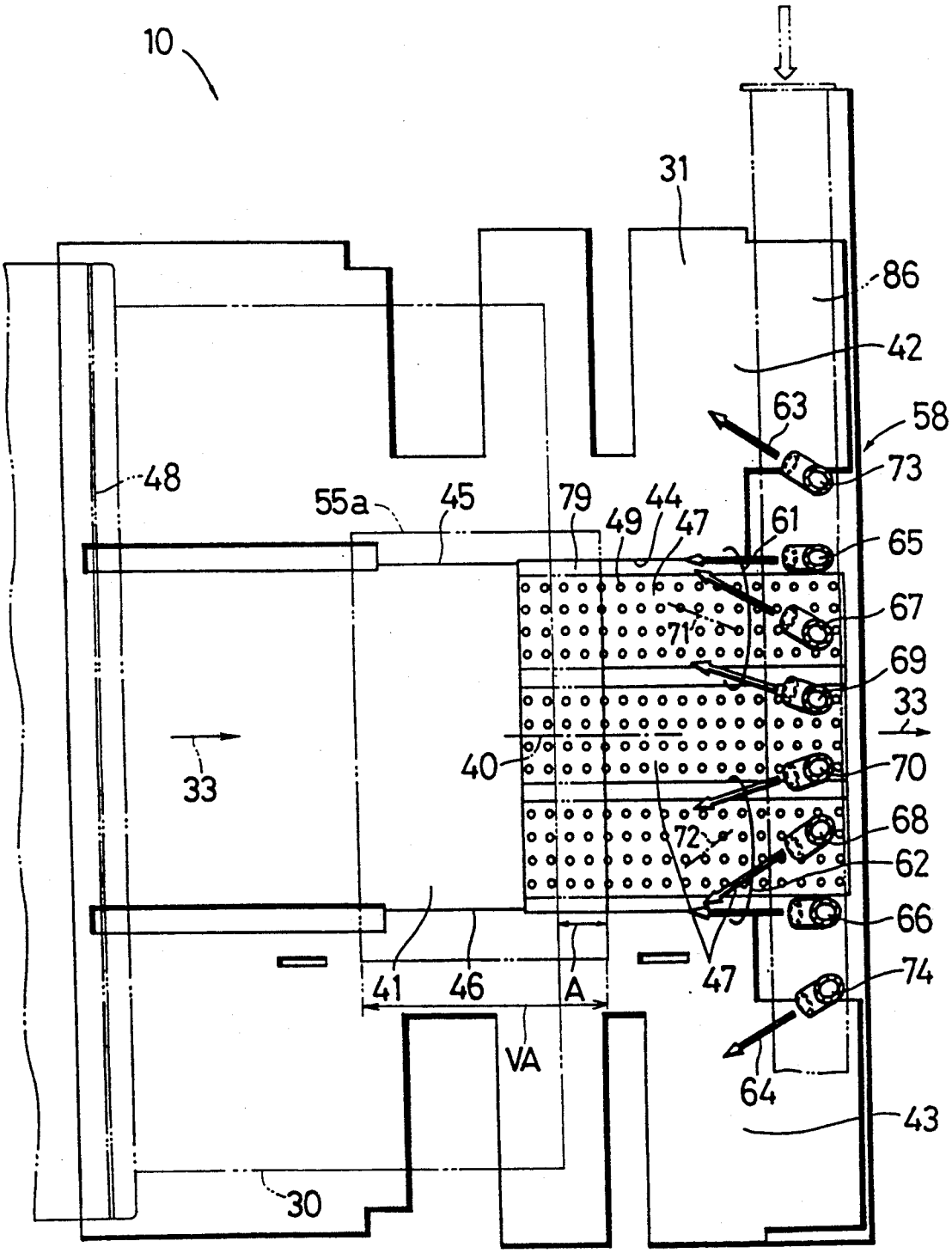
FIG. 4 is a top view showing a sheet feeding apparatus 10.
Figure 5:
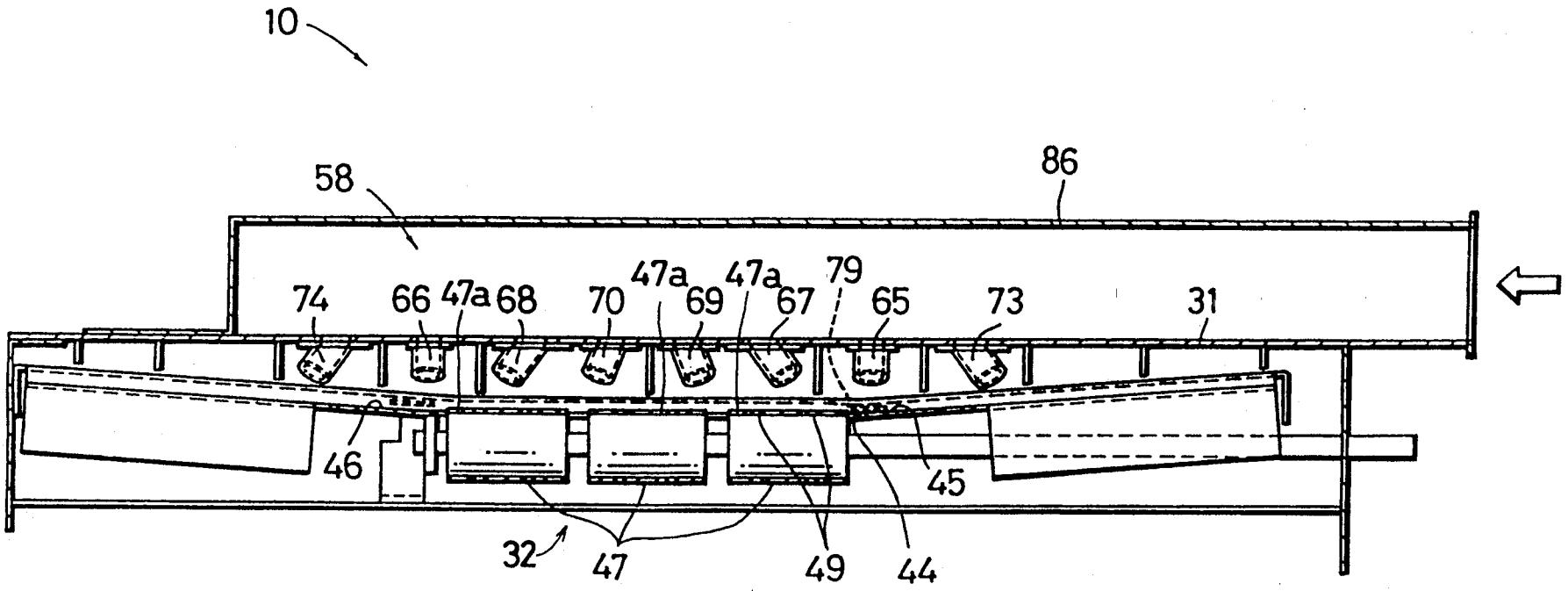
FIG. 5 is a plan view showing the sheet feeding apparatus 10.

FIG. 4 is a schematic top view showing the sheet feeding apparatus 10 and FIG. 5 is a plan view of the sheet feeding apparatus 10 viewed from the downstream side with respect to the feeding direction (i.e., at the right side of FIGS. 2 and 4.) As seen from these figures, a plurality of recording papers indicated at 30 are stacked up on a laying plate 31. A first feeding unit 32 is adapted to feed the bottommost stacked recording paper 30*a* of all the recording papers 30 stacked on the laying plate 31. At the downstream side of the first feeding unit 32 with respect to the feeding direction (at the right side in FIGS. 2 and 4) is arranged a second feeding unit 34 for further feeding the recording paper 30*a* fed by the first feeding unit 32. The second feeding unit 34 comprises a pair of rollers 35, 36 disposed above and below for feeding the recording paper therebetween and guide members 37, 38 for guiding the recording paper.

The laying plate 31 is constructed laterally symmetrically about the symmetry plane 40 through the center position thereof in the widthwise direction (longitudinal direction in FIG. 4.) The laying plate 31 comprises a substantially horizontal central laying portion 41 and side laying portions 42, 43 extending in the widthwise direction from the opposite sides of the central laying portion 41. At an downstream end portion of the central laying portion 41 with respect to the feeding direction is formed a notch 44. To the notch 44 is faced the first feeding unit 32. The more the side laying portions 42, 43 are away from the central laying portion 41 in the widthwise direction, the more they are slanted upwardly. The boundaries 45, 46 between the central laying portion 41 and the side laying portions 42, 43 are substantially parallel to the feeding direction 33.

The first feeding unit 32 has a plurality of stretching belts 47 (in this embodiment 3 belts) for feeding the paper arranged with adjoining to one another in the widthwise direction. These belts 47 are endless belts and upper stretching portions 47*a* thereof are substantially horizontal. In this embodiment, the stretching portion 47*a* is a bit more slanted upwardly as it becomes more downstream of the feeding direction 33. Similarly, the laying plate 31 is more slanted upwardly as it becomes more downstream of the feeding direction 33. Thus, the upstream ends of the stacked recording papers 30 with respect to the feeding direction are in contact with a rear end defining member 48, and thereby aligned. The belt 47 has many air penetration holes and extends along the feeding direction 33. The belt 47 is rolled on rollers 51, 52 disposed with spaced to each other fore-and-aft in the feeding direction. The rollers 51, 52 are driven by a motor 53 to be described below (see FIG. 7 to be described below.) Right below the upper stretching portion 47*a* of the belt 47 is disposed a vacuum attracting box 55 having an opening 55*a* in the top face so as to face above. The vacuum attracting box 55 is sucked by a fan to make the interior space 56 thereof vacuum, for example, $-40$ to $-50$ mm$H_2O$. By the opening 55*a*, a vacuum attracting area VA is formed in the upper stretching portion 47*a* of the belt 47.

Rollers 35, 36 of the second feeding unit 34 are driven by a motor 57 (see FIG. 7 to be described below.) In order to separate the recording papers 30 stacked on the laying plate 31 up and down and feed only the bottommost stacked recording papers 30*a* one by one, a nozzle member 58 is disposed. The nozzle member 58 is disposed above the belt 47 and downstream of the laying plate 31 with respect to the feeding direction 33. The nozzle member 58 jets air flows 61, 62; 63, 64 from each position thereof laterally symmetrically about the symmetry plane 40 at the upper stretching portion 47*a* of the belt 47 provided in the first feeding unit 32 and also at substantially end portions of the recording papers 30 stacked on the stretching portion 47*a*. The air flow 61, 62 are flat in the widthwise direction of the laying plate 31. A plurality of nozzles (in this embodiment 3 nozzles) 65, 66; 67, 68; 69, 70 forming the air flows 61, 62 are arranged symmetrically about the symmetry plane 40. The nozzles 67 to 70 disposed closer to the widthwise center jet the air more outwardly in the widthwise direction as they becomes more upstream of the feeding direction 33 (the left side in FIG. 4.) The nozzles 65, 66 disposed outwardly in the widthwise direction jet the air parallel to the feeding direction 33. These nozzles 65, 66 are positioned in the peripheries of the boundaries 45, 46. The air jetted from the nozzles 65 to 70 are indicated by bold arrows. Thus, the air flow 61, 62 are collected to central lines 71, 72 thereof. Accordingly, the collected air flows are inflated up and down in the stacked recording papers 30. Thereby, the stacked recording papers 30 are reliably separated up and down into the bottommost recording paper 30*a* and the remaining ones. In the case where the recording papers 30 have a wide width, the air flows 63, 64 are jetted from the nozzles 73, 74 respectively together with the air flows 61, 62 so that the recording papers 30 having the wide width can be reliably separated up and down. The nozzles 65, 66 are disposed in the peripheries of the boundaries 45, 46. This creates the spaces respectively in the peripheries of the boundaries 45, 46 between the bottom-most recording paper 30*a* tightly vacuum attracted to the upper stretching portion 47*a* of the belt 47 provided in the first feeding unit 32 and the remaining recording papers not being vacuum attracted. To these spaces are blown the collected air flows 61, 62, thereby enabling the further reliable separation of the recording papers up and down. The nozzles 65 to 70, 73, and 74 are connected with a duct 86, to which compressed air is supplied from the fan.

Figure 6:
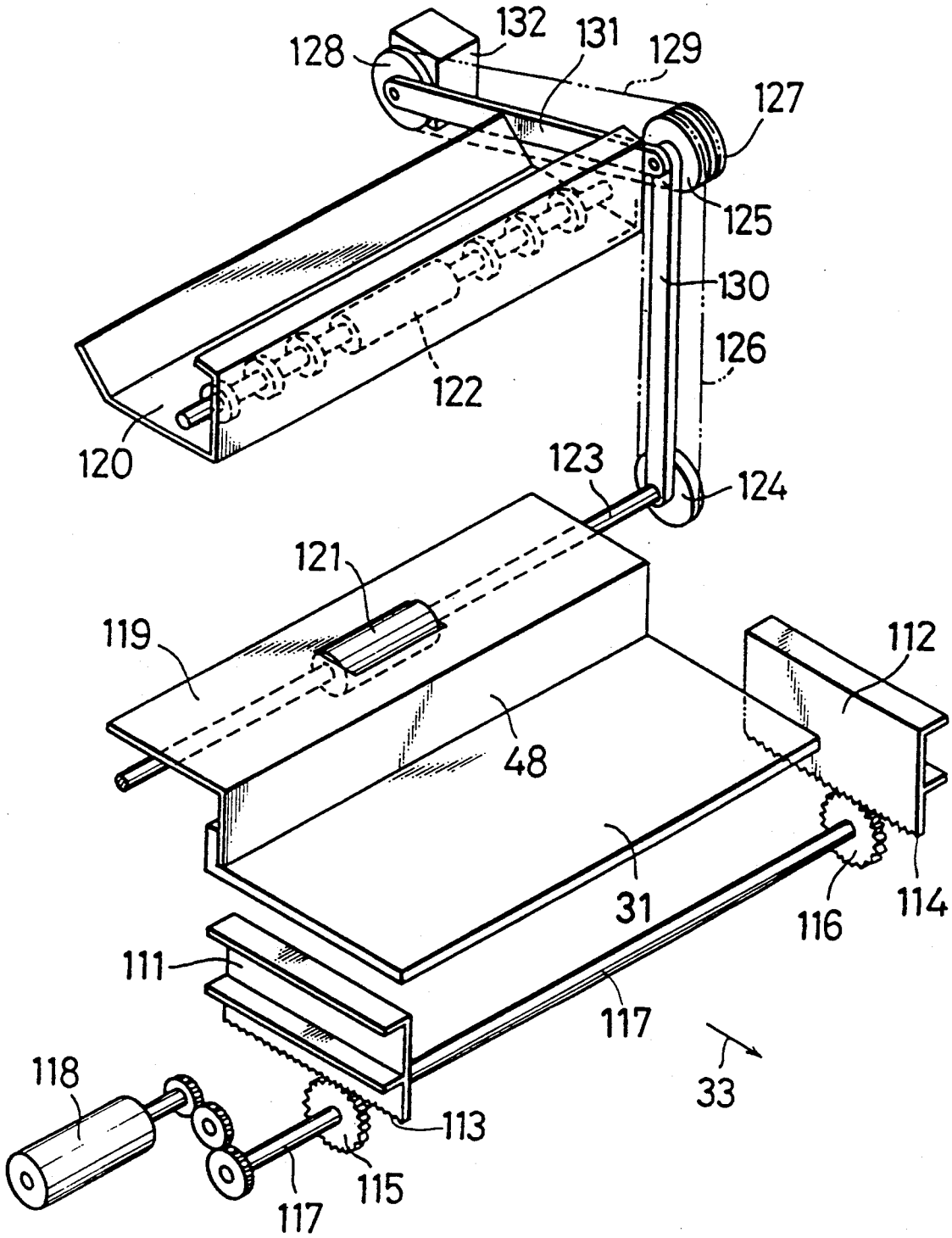
FIG. 6 is an exploded perspective view showing a construction related to a rear end defining member 48.

FIG. 6 is a schematic exploded perspective view showing the present embodiment. In this embodiment, the rear end defining member 48 is arranged movably fore-and-aft in the feeding direction 33. The rear end defining member 48 is fixed to support members 111, 112 in which racks 113, 114 are formed. These racks 113, 114 are meshed with pinions 115, 116. The pinions 115, 116 are fixed to a shaft 117 and driven by a motor 118. Thereby, the rear end defining member 48 is made movable fore-and-aft in the feeding direction 33.

The rear end defining member 48 is provided with a lower guide member 119 and an upper guide member 120 for guiding the recording paper 30 to be stacked. A roller 121 is projected from the lower guide member 119 and a roller 122 opposing to and contacting with the roller 121 is projected from the upper guide member 120. The roller 122 is in pressing contact with the roller 121 by the spring and thereby the recording paper 30 held between the rollers 121, 122 is fed in the direction indicated by an arrow 103 in FIG. 2. The rotating shaft 123 fixed to the roller 121 to drive the roller 121 has a pulley 124 fixed thereto. A belt 126 is rolled on the pulley 124 and a pulley 125. On a pulley 127 formed integrally with the pulley 125 and a pulley 128 is rolled a belt 129. Pulleys 124, 125; 127, 128 are respectively supported by links 130, 131. The pulley 128 is drivingly rotated by a motor 132 and rotatably disposed in a fixed position.

Accordingly, when the support members 111, 112, the rear end defining member 48, the guide members 119, and the roller 121 are moved by the motor 118 fore-and-aft in the feeding direction 33, an angle formed between the links 130 and 131 is allowed to change. In addition, the roller 121 is allowed to be drivingly rotated by the rotating power of the motor 132.

Figure 7:
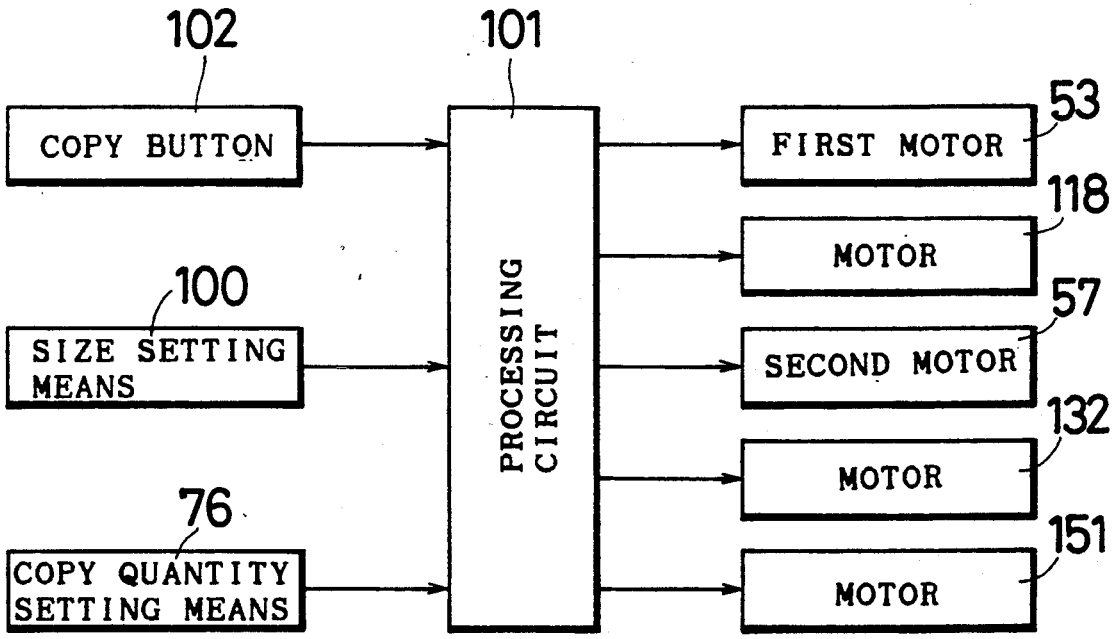
FIG. 7 is a block diagram showing an electrical configuration of the embodiment shown in FIGS. 2 to 6, FIGS. 8A and 8B are flow charts showing an operation of a processing circuit 101 shown in FIG. 7.

FIG. 7 is a block diagram showing an electric configuration of the embodiment shown in FIGS. 2 to 6. Indicated at 101 is a processing circuit which can be actualized by a microcomputer or the like. The processing circuit 101 is adapted to receive outputs from a copy quantity setting means 76, a size setting means 100 for setting the size of the recording paper 30, and a copy button 102 actuated by an operator, control the motor 132 in accordance with the received outputs, and further control the motor 118 for drivingly moving the read end defining member 48.

Figure 8B:
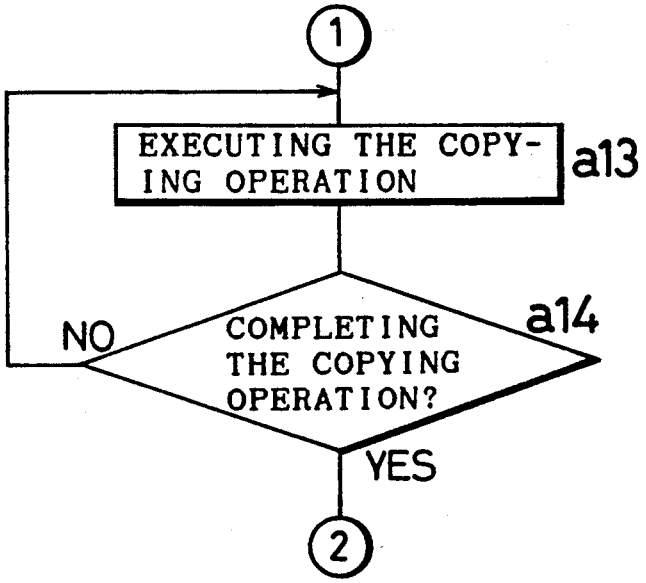
Figure 8A:
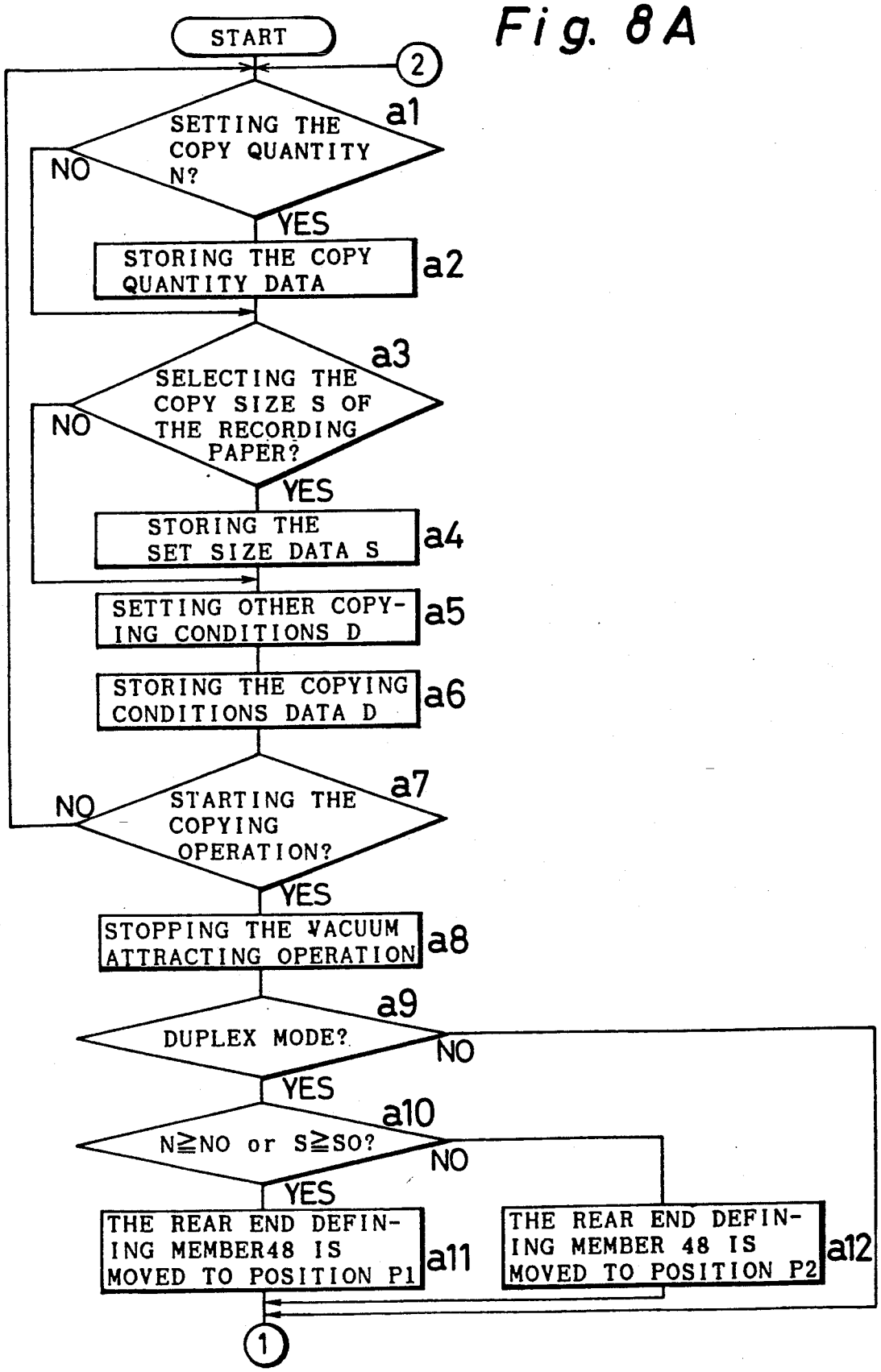

FIGS. 8A and 8B flow charts showing an operation of the processing circuit 101 shown in FIG. 7. In Step a1, it is detected whether the operator has set the copy quantity N. In the case where the operator has set the copy quantity N, the copy quantity data N is stored in Step a2. In Step a3, the sizes of the recording paper 30 to be copied is selected. In other words, the sizes of the recording paper 30 is selected out of for example A4, B4, A5, and B5 formats standardized by Japanese Industrial Standards (JIS). In the case where the determination made in Step a1 is in the negative, the processing routine proceeds to Step a3 skipping Step a2. In Step a4, the set size data S of the recording paper 30 is stored.

In Step a5, other conditions required for executing the copying operation to the recording paper 30 are set. Such conditions include a condition indicative of whether the copying operation is in a simplex mode or a duplex mode. In Step a6, the copying condition data D set in Step a5 is stored. In step a7, it is determined whether the operator has actuated the copy button 102 (see FIG. 7) to start the copying operation. In the case where the determination is in the negative, this routine returns to Step a1 to repeat the aforementioned processings. In the case where the determination is in the affirmative, the routine proceeds to Step a8, in which the vacuum attracting operation by the vacuum attracting box 55 is stopped.

In Step a9, it is determined whether the duplex mode is set as a copying condition in accordance with the copying condition data D. In the case where the determination is in the affirmative, the routine proceeds to Step a10, in which it is determined whether at least one of the following conditions is satisified. One condition is whether the copy quantity data N is not smaller than a predetermined quantity threshold data NO, and the other condition is whether the size data S is not smaller than a predetermined size threshold data SO. In the case where the determination made in Step a10 is in the affirmative, it means that a relatively large number of the recording papers 30 are to be contained in the intermediate tray 12, or the recording papers 30 of relatively large weight per sheet are to be contained in the intermediate tray 12.

Thereafter, the routine proceeds to Step a11, in which the processing circuit 101 causes the motor 118 to drive. Thereby, the rear end defining member 48 is moved so as to position the downstream end of the recording paper 30 downstream of the vacuum attracting area VA with respect to the feeding direction 33. This enables the ratio of the air flows from the nozzle member 58 attracted by the vacuum attracting box 55 through the opening 55*a* to become zero, thereby maximally utilizing the power caused by the air flows at the time of the separating operation of the recording papers 30.

Subsequently, the routine proceeds to Step a13, in which the copying operation is to be executed. In Step a14, it is determined whether the copying operation has been completed. In the case where the copying operation has not been completed, the copying operation continues to be executed in Step a13. In the case where the copying operation has been completed, the routine returns to Step a1 and repeat the aforementioned processings.

In the case where the determination made in Step a9 is in the negative, the routine directly proceeds to Step a13. In addition, in the case where the determination made in Step a1 is in the negative, it means that a relatively small number of recording papers 30 are to be contained in the intermediate tray 12, or the recording papers 30 of relatively less weight are to be contained in the intermediate tray 12. Accordingly, in this case, the routine proceeds directly to Step a12, in which the processing circuit 101 causes the motor 118 to drive. Thereby, the rear end defining member 48 is moved so as to place the downstream end of the recording paper 30 with respect to the feeding direction 33 at a predetermined intermediate position P2 in the vacuum attracting area VA.

Figure 9:
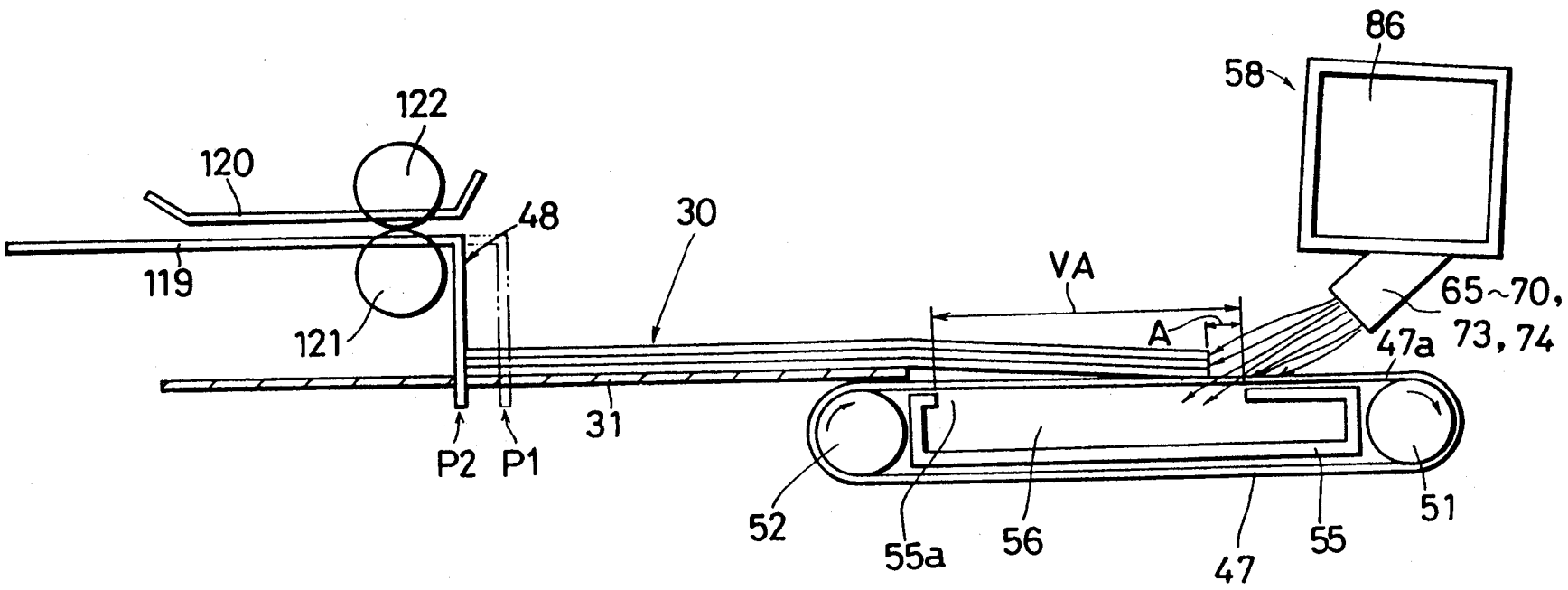
FIG. 9 is a cross sectional view showing an operation of the embodiment.

Accordingly, the ratio of the air flows, in other words, the area of the open suction area A unconverted by the stacked sheets 30 shown in FIG. 4, and FIG. 9, from the nozzle member 58 attracted by the vacuum attracting box 55 through the opening 55*a* is increased, thereby reducing the power caused by the air flow for separating the recording papers 30 by a predetermined amount from the maximal power. Thereafter, the routine proceeds to Step a13 and the subsequent Steps in which the aforementioned processings are to be executed.

As described above, in this embodiment, the copying quantity data N and the size data S concerning the size of the recording papers 30 to be used set prior to the copying operation are compared with the quantity threshold data NO and the size threshold data SO respectively. In accordance with these comparison results, the ratio of the air flows from the nozzle member 58 substantially contributing to separation of the recording papers 30 is made controllable. As a result, occurrences of the sheet feeding failure, multiple feeding, and flapping of the recording papers 30 due to the excessive quantity of the air flow as explained with reference to the prior arts can be prevented.

Figure 10:
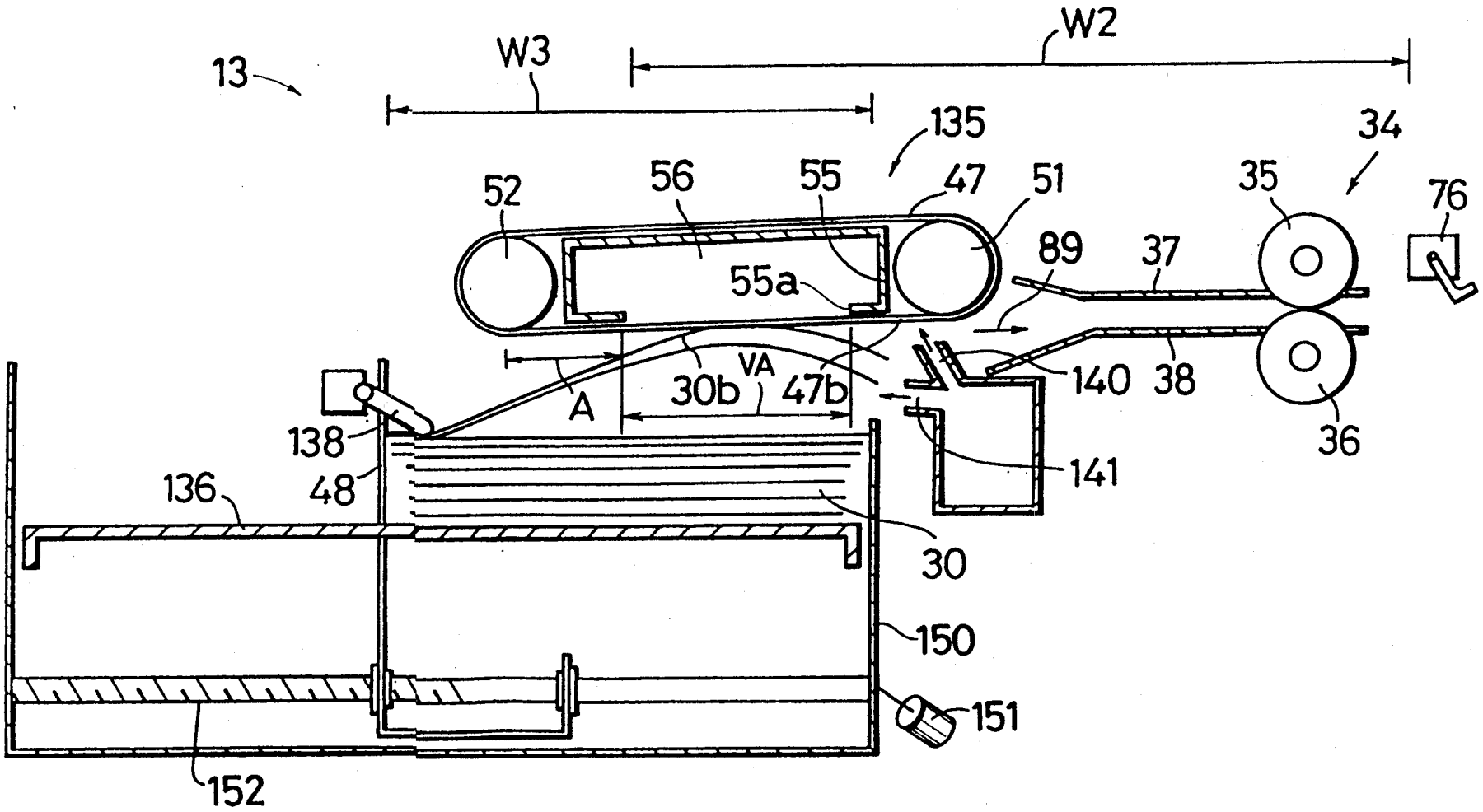
FIG. 10 is a cross sectional view showing another embodiment of the invention.

FIG. 10 is a cross sectional view of another embodiment of the invention. The embodiment is the sheet feeding apparatus 13 shown in FIG. 3 and partially similar to the foregoing embodiment. It should be noted that, in this embodiment, a first feeding unit 135 is disposed above the sheets placed on a laying plate 136. The first feeding unit 135 comprises an endless stretching belt 47 having many air penetration holes for feeding the sheets and extending along the feeding direction 33, rollers 51, 52 on which the belt 47 is rolled, a vacuum attracting box 55 similar to the first embodiment. The vacuum attracting box 55 is disposed right above a lower stretching portion 47*b* of the belt 47 and has an opening in the bottom face thereof, the opening facing below.

Further, a rear end defining member 48 is screwedly fixed to a screw bar 152 arranged in parallel with the feeding direction 33 in a housing 150. The screw bar 152 is drivingly rotated by a motor 151 so as to move the rear end defining member 48 is made reciprocatingly movable along the feeding direction 33.

The bottommost recording paper 30*b* of the recording papers 30 stacked on the laying plate 136 is detected by a sensor 138. The position of the bottommost recording paper 30*b* is maintained at a constant position by a construction similar to the one to be described with reference to FIG. 11. Other constructions are similar to the embodiment described with reference to FIGS. 2 to 8.

Figure 11:
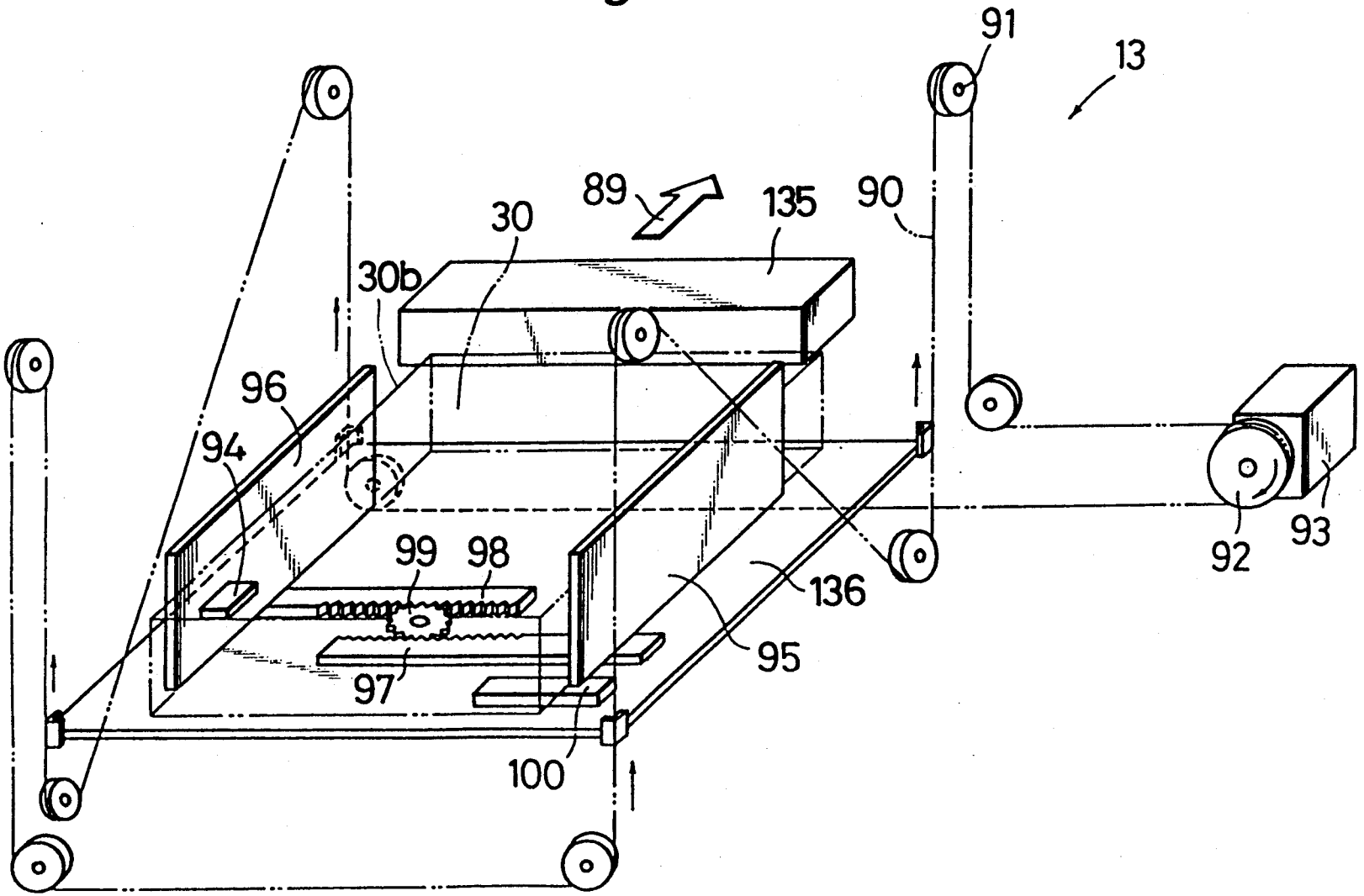
FIG. 11 is a schematic perspective view showing a recording paper feeding unit 13.

FIG. 11 is a schematic perspective view showing the sheet feeding apparatus 13. The recording papers 30 are stacked on the horizontal laying plate 136. The uppermost recording paper is fed in the feeding direction 89 by the first feeding unit 135 to a transporting path 14 as shown in FIG. 2. The laying plate 136 is connected with a wire 90 which is rolled on a plurality of pulleys 91. The pulleys 91 are connected with a pulley 92 which is driven by a motor 93. The position of the uppermost recording paper of the stacked recording papers 30 is detected by a sensor 94, and the motor 93 is driven so as to hold the position of the uppermost recording paper constant. Both sides of the recording papers 30 are aligned by a pair of lateral end defining members 95, 96 arranged on the rearside of the laying plate 136. To the lateral end defining members 95, 96 are fixed racks 97, 98 which are meshed with a pinion 99 disposed rotatably on the laying plate 136. Accordingly, the lateral end defining member 95, 96 causes the recording papers 30 to be fed with the center position thereof in the widthwise direction being held at the constant predetermined position.

The widthwise position of the lateral end defining member 95 is detected by a size detecting means 100. The width of the recording paper 30 can be detected by the size detecting plate 100. Accordingly, the length of the recording paper 30 in the feeding direction 33, 89 can be detected. The recording paper 30 has a predetermined standardized shape, and therefore the length thereof in the feeding direction can be obtained by detecting the width thereof by the use of the side detecting means 100.

A nozzle member 140 is disposed for forming the air flow in order to separate the recording papers 30 stacked up on the laying plate 136 up and down and cause only the uppermost recording paper 30*b* to be vacuum attracted to the lower stretching portion 47*b* of the belt 47. Also, a nozzle member 141 is disposed for floating the stacked recording papers 30 by the air flow directed therefrom. The air flow forming nozzle 140 is similar to the nozzle member 58 in its construction.

The sheet feeding apparatus 13 thus constructed may control the area of the open suction area A uncovered by the stacked recording papers 30 in the vacuum attracting area VA created by the opening 55*a* of the vacuum attracting box described in the foregoing embodiment. By having such an additional function, the sheet feeding apparatus 13 of this embodiment can demonstrate the effect similar to the one in the foregoing embodiment.

A belt provided in a first feeding unit is constructed so as to vacuum attract the recording paper. However, it may also be appropriate that the belt have many tiny irregularities formed thereon so as to increase a coefficient of friction with the sheet to be fed, eliminating the need for a vacuum attracting box or the like and thereby reducing the size of the first feeding unit.

The embodiment of the invention is not limited to a use in a copying machine for feeding a recording paper. The invention can be embodied in a printer for feeding a recording paper. Further, the invention can be widely applied for feeding the sheets other than the recording paper.

It is understood by those skilled in the art that the foregoing description is a preferred embodiment of the disclosed device and that various changes and modifications may be made in the invention without departing from the spirit and scope thereof.

Further, this invention may be embodied in several forms without departing from the spirit of essential characteristics thereof. The invention is therefore illustrative and not restrictive, since the scope of the invention is defined by the appended claims rather than by the description preceding them, and all changes that fall within meets and bounds of the claims, or equivalence of such meets and bounds are therefore intended to embraced by the claims.

What is claimed is:

1. A sheet feeding apparatus comprising:

a laying plate having a centerline running in the feeding direction for receiving a stack of a plurality of sheets;

an endless feeding belt providing a feeding surface for vacuum feeding a sheet to be fed from the stack in a feeding direction, the feeding belt located adjacent the position of the sheet to be fed a vacuum attracting box having an opening in the sheet feeding direction and facing the feeding belt for creating a vacuum attracting area in the feeding belt at an area corresponding and opposing to the opening and enabling the feeding belt to attract the sheet wherein the feeding belt is intermediate the vacuum attracting box and the sheet;

air flow forming means disposed downstream of the laying plate in the feeding direction for jetting a plurality of air flows directed between the sheets in directions that are directed outwardly from the centerline of the laying plate in the feeding direction and in directions that are directed parallel to the feeding direction;

a rear end defining member disposed upstream of the feeding belt in the feeding direction and movable in the feeding direction for aligning the upstream end of the sheets stacked on the laying plate by contacting the upstream ends of the sheets;

means for detecting at least one property of the sheets in the stack, which property comprises the quantity of the sheets and the size of the sheets and for moving the rear end defining member in accordance with the detected property to provide an uncovered vacuum attracting area, which area becomes larger as the detected quantity or the detected size becomes smaller and reduces the quantity of air flow being directed between the sheets.

2. A sheet feeding apparatus is defined in claim 1 wherein the feeding belt is disposed below the sheets.

3. A sheet feeding apparatus as defined in claim 1 wherein the feeding belt is disposed above the sheets.

4. A sheet feeding apparatus as defined in claims 1, 2, or 3 wherein the feeding belt envelops the vacuum attracting box, and is rolled on a pair of spaced apart rollers and has a plurality of air penetration holes throughout the feeding surface.

5. A sheet feeding apparatus as defined in claim 1 wherein the rear end defining member has the laying plate fixed thereto and moves the stack of sheets in the feeding direction to control the area of the open suction area uncovered by the stack of sheets in the vacuum attracting area.

* * * * *